US005178194A

United States Patent [19]

Uchino et al.

[11] Patent Number: 5,178,194

[45] Date of Patent: Jan. 12, 1993

[54] MULTIPLY CONNECTED AIR CORE COIL WINDING APPARATUS

[75] Inventors: Youji Uchino; Akira Inomata, both of Saitama, Japan

[73] Assignee: Pioneer Electronic Corporation, Tokyo, Japan

[21] Appl. No.: 810,357

[22] Filed: Dec. 18, 1991

Related U.S. Application Data

[63] Continuation of Ser. No. 511,694, Apr. 20, 1990, abandoned.

[30] Foreign Application Priority Data

Aug. 23, 1989 [JP] Japan ..... 1-214878

[51] Int. Cl.[5] ..... B21F 3/00; H01B 11/04

[52] U.S. Cl. ..... 140/92.1; 242/7.09

[58] Field of Search ..... 242/7.09, 7.14; 29/6.05; 72/142; 140/92.9, 92.1

[56] References Cited

U.S. PATENT DOCUMENTS

| | | | |
|---|---|---|---|
| 1,944,870 | 1/1934 | Apple et al. | 140/92.2 |
| 2,356,912 | 8/1944 | Bennett, Jr. et al. | 72/142 X |
| 3,142,889 | 8/1964 | Austin | 29/155.9 |
| 3,412,354 | 11/1969 | Sattler | 29/605 |
| 3,938,748 | 2/1976 | Camardella | 242/7.09 |
| 4,008,594 | 2/1977 | Noyce | 72/142 |
| 4,021,000 | 5/1977 | DeMauro | 242/7.09 X |
| 4,558,835 | 12/1985 | Sunaoka | 242/7.14 X |
| 4,722,486 | 2/1988 | Camardella | 140/92.2 X |

FOREIGN PATENT DOCUMENTS

| | | | |
|---|---|---|---|
| 640121 | 12/1936 | Fed. Rep. of Germany . | |
| 3227468 | 4/1983 | Fed. Rep. of Germany . | |
| 55-98815 | 7/1980 | Japan | 242/7.09 |
| 922743 | 3/1963 | United Kingdom . | |

*Primary Examiner*—Daniel P. Stodola
*Assistant Examiner*—Michael R. Mansen
*Attorney, Agent, or Firm*—Sughrue, Mion, Zinn, Macpeak & Seas

[57] ABSTRACT

A multiply connected air core coil winding apparatus is provided in which a winding core is protruded and retracted through a first side frame in order to position the winding core between the first side frame and a second side frame, the winding core being rotated when so positioned in order to form a side face of an air core coil. The second side frame is capable of being drawn towards and away from the first side frame. A pocket is provided at one of the side frames for housing the air core coil when the winding material has been completely wound. As a result, multiple air core coils can be wound without cutting the winding material of a first air core coil. In a second embodiment of the present invention, a multiply connected air core coil winding apparatus is provided, comprising a winding core which can be protruded and retracted through a hole of a side frame face so as to be positioned between a pair of side frames, the winding core being rotated for forming a side face of an air core coil, similar to the first embodiment. One side frame is movable so as to be drawn towards and away from the other side frame, and a plurality of side frame faces are provided on one of the side frames which can be rotated in a direction perpendicular to a winding rotation shaft. One side frame is positioned so as to be opposed to the other side frame, and the winding core is protruded and retracted on the rotation shaft of the winding wire.

3 Claims, 4 Drawing Sheets

MULTIPLY CONNECTED AIR CORE COIL WINDING APPARATUS

This is a continuation of application Ser. No. 07/511,694 filed Apr. 20, 1990, now abandoned.

BACKGROUND OF THE INVENTION

The present invention relates to a winding apparatus for winding a multiply connected air core coil, such as a tracking coil used in an optical pickup for reading signals from an optical information storage disk. The multiply connected air core coil includes two or more air coils of a predetermined length of winding material.

Thus far, air core coils where two or more air coils are connected together and used as a set, such as tracking coils, have been made by cutting a winding material whenever one air coil has been wound.

In the conventional winding apparatus, the winding material is cut whenever the winding operation for one coil is completed. This is done for the following reasons. When the air core coil is produced, the projection portion of the winding core rotates so as to wind the winding material around the projection portion of the winding core. Therefore, if the winding material is not cut before the next winding step, the winding core rotates with the first air core coil completely wound. Thus, the air core coil which has been made is rotated and the next air core coil cannot be made. Therefore, the winding material should be cut to a predetermined length in the conventional winding apparatus. On the other hand, if a member supplying the winding material to the winding core rotates around the winding core, the winding core itself need not rotate. However, if this structure is included in the air coil core winding apparatus, the mechanism becomes extremely complicated.

Further in the conventional winding apparatus, when two or more air coils are connected and used as a set, the winding materials which have been cut must be electrically connected to terminals. Thus, it is necessary to prepare a board for soldering the terminals. Consequently, a solder process is required in addition to the board.

SUMMARY OF THE INVENTION

An object of the present invention is to solve the problems of the prior art by providing a multiply connected air core coil winding apparatus for winding an air core coil after reaching the end of a predetermined length of a winding material without cutting the winding material of a first air core coil.

The object of the present invention is accomplished by the provision of two embodiments of the present invention as described below.

In a first embodiment of the present invention, a multiply connected air core coil winding apparatus is provided comprising a winding core which can be protruded and retracted through a hole of a side frame face. When the winding core is protruded through the hole of the side frame face, it is thus positioned between a pair of side frames. The winding core is rotated while located between the pair of side frames so that winding material is wound on the projection portion of the winding core whereby a side face of an air core coil is formed. One side frame is movable so as to be drawn towards and away from the other side frame, and a pocket is provided disposed at one of the side frames for housing the air core coil where the winding material has been completely wound. The side frames are provided to prevent deformation of the air core coil.

In a second embodiment of the present invention, a multiply connected air core coil winding apparatus is provided, comprising a winding core which can be protruded and retracted through a hole of a side frame face so as to be positioned between a pair of side frames, the winding core being rotated for forming a side face of an air core coil, similar to the first embodiment. One side frame is movable so as to be drawn towards and away from the other side frame, and a plurality of side frame faces are provided on one of the side frames which can be rotated in a direction perpendicular to a winding rotation shaft. One side frame is positioned so as to be opposed to the other side frame, and the winding core is protruded and retracted on the rotation shaft of the winding wire.

In the first embodiment, the winding core is protruded through a first side frame and another side frame is drawn towards the first side frame. The winding material is wound on the winding core while the winding core is located between both the side frames. After that, the winding core is retracted through the first side frame, and the air core coil where the winding material has been wound is removed from the winding core.

The air core coil is housed in the pocket without cutting the winding material. After that, the winding operation is repeated.

In the second embodiment, a first side frame is rotated in the direction perpendicular to the rotation shaft of the winding wire. A first side frame face is positioned so as to be opposed to another side frame. The second side frame is movable so as to be drawn towards and away from the first side frame face. After that, the winding material is wound on the protruded winding core.

After this winding operation is completed, the side frame is separated from the selected first side frame face. Next, the first side frame is rotated in the direction perpendicular to the winding shaft so than a second side frame face is opposed to the second side frame.

The winding operation is performed in the same manner described above. After the winding material is wound on the winding core of each side frame face, the winding core is retracted and the air core coil is removed.

BRIEF DESCRIPTION OF THE DRAWINGS

FIG. 1 is a perspective view of the principal section;

FIG. 2 is a sectional view where the principal section is assembled;

FIG. 3 is a front view of FIG. 2; and

FIG. 4 is the overall front view.

FIG. 5 is a sectional view; and

FIG. 6 is a front view.

DETAILED DESCRIPTION OF THE PREFERRED EMBODIMENT

Referring to FIGS. 1 to 4, the first embodiment is described in the following.

Figure 4:
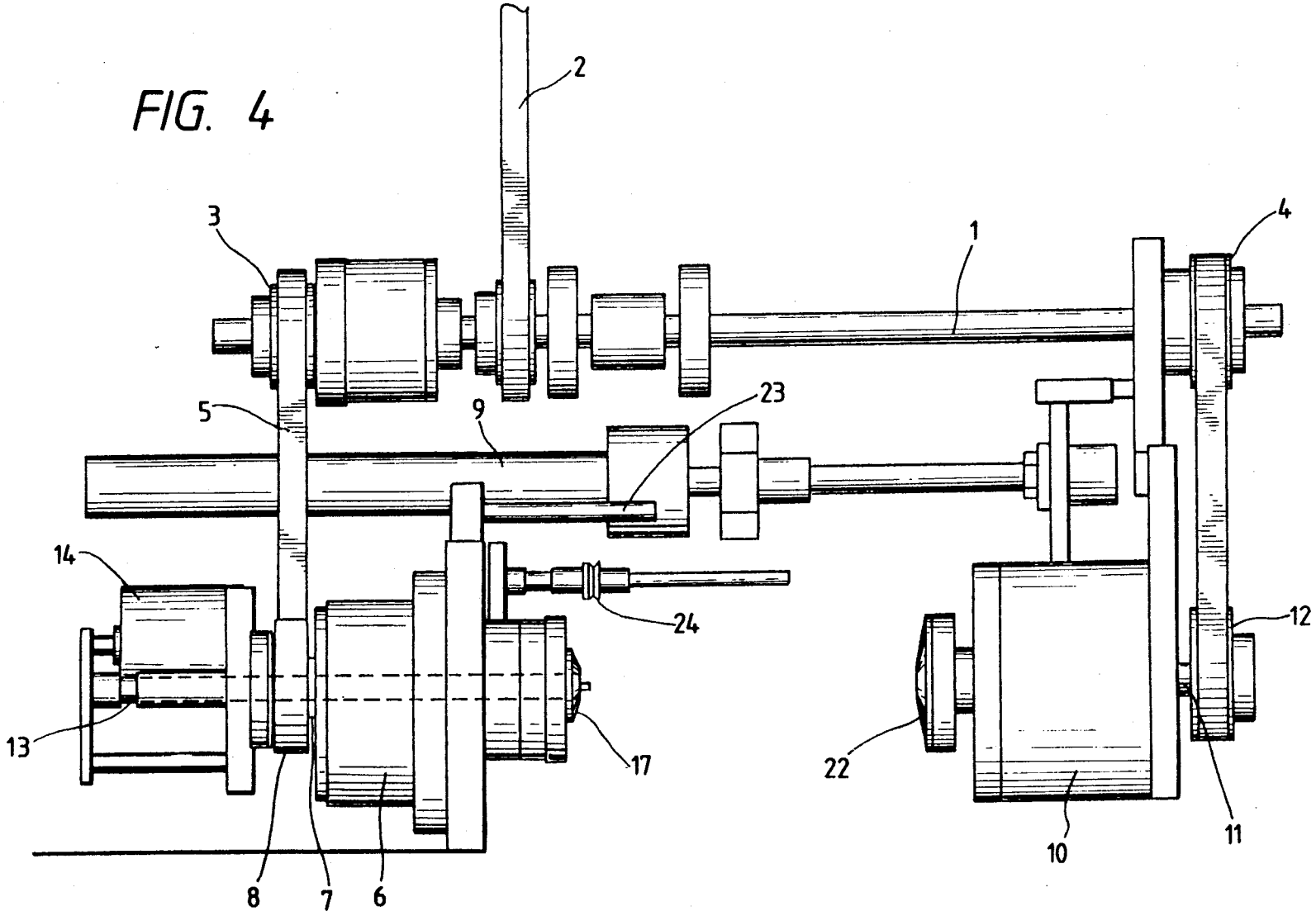

In FIG. 4, a rotation shaft 1 is rotated by a motor via a belt 2. The rotation shaft 1 is provided with a fixed pulley 3 and a slide pulley 4 which is axially movable. The rotation of the fixed pulley 3 is transferred to a pulley 8 of a shaft 7 supported by a shaft support 6 via a belt 5. However, the rotation is not transferred to the shaft support 6 itself.

The slide pulley 4 slides on the rotation shaft 1 by a motion of a cylinder 9, the rotation being transferred to a pulley 12 of a shaft 11 supported by a shaft support 10 which slides along therewith.

Figure 1:
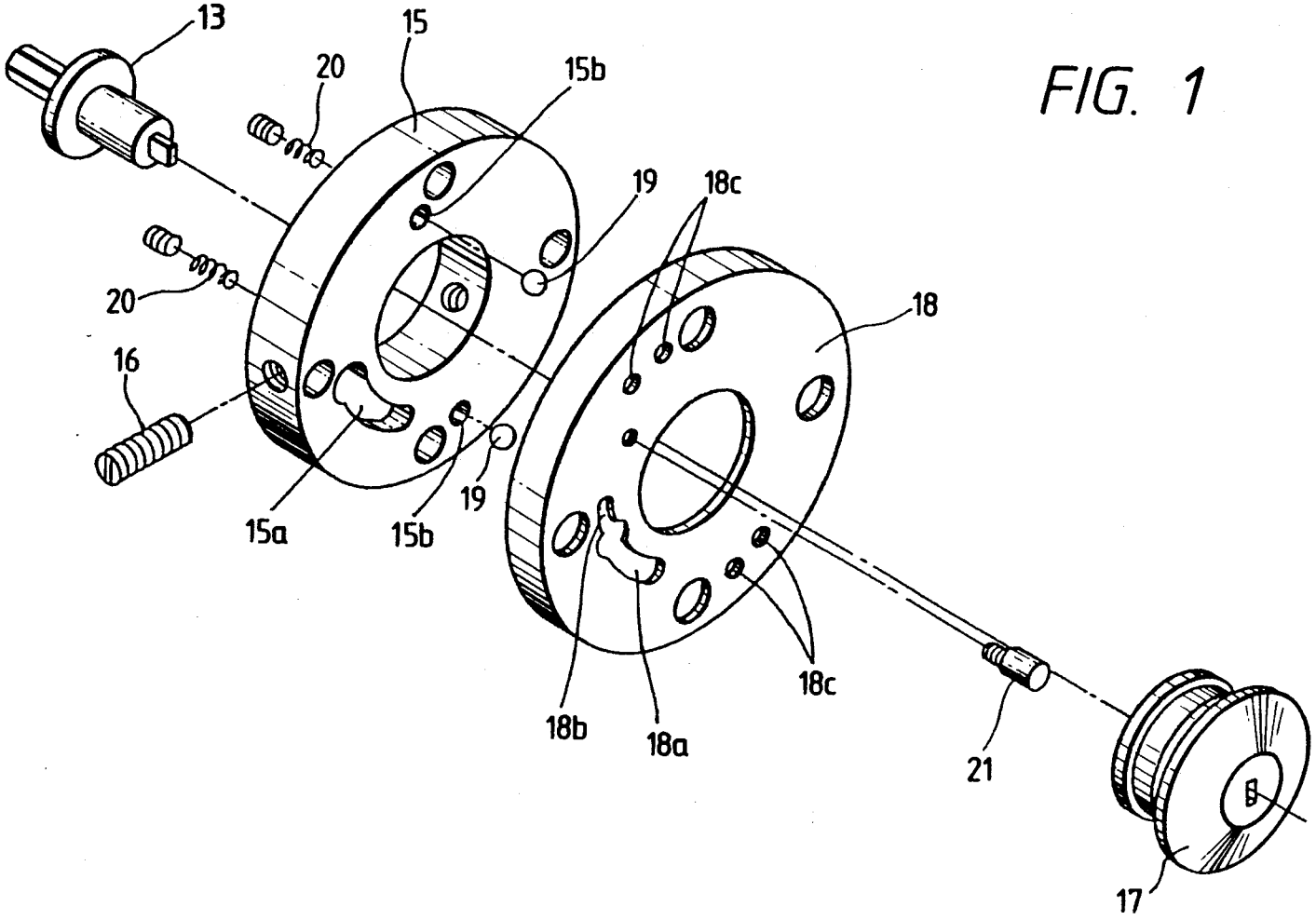
FIGS. 1 to 4 show an embodiment of the first embodiment of the present invention.
Figure 2:
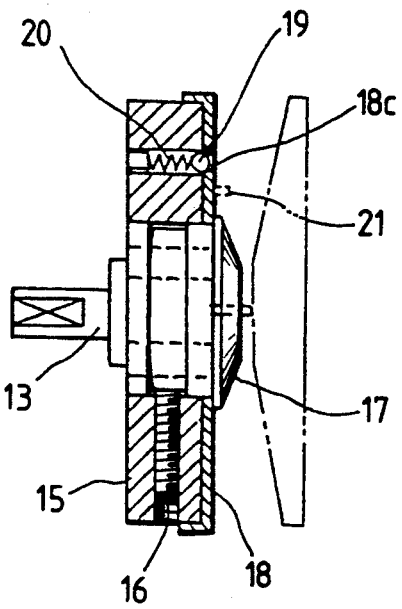

The shaft 7 houses a winding core 13 shown in FIG. 1, the winding core 13 being slid axially by a cylinder 14. The winding core 13 is rotated along with the shaft 7.

In FIG. 1, a pocket body 15 is provided with an arc shape pocket 15*a* which houses an air core coil once a winding material has been completely wound therearound, the pocket body 15 being rotated along with the shaft 7.

The pocket body 15 has a side frame face 17 at the center thereof which is fastened with a set screw 16. The winding core 13 can be protruded and retracted through the side frame face 17. That is, the projection portion of the winding core 13 is projected through the hole of the side frame face 17 so that the winding material can be wound thereon. Between the side frame face 17 and the pocket body 15, a pocket cover 18 is provided with an arcuate slotted hole 18*a* whose shape is nearly the same as the pocket 15*a* and a narrow slotted hole 18*b* which is disposed at one end thereof, the pocket cover being movably mounted. Additionally, the cover 18 has two pairs of parallel holes 18*c* at the same axial position as one another. Holes 15*b* of the pocket body 15 houses balls 19 and 20. The holes 15*b* are radially positioned such that they can be respectively aligned with the pairs of parallel holes 18*c*. In this manner, balls 19 disposed in the hole 15*b* can engage one hole in each pair of parallel holes 18*c*.

When the cover 18 is positioned such that the ball 19 engages one hole of each pair of parallel holes 18*c*, the pocket 15*a* is aligned with the slotted hole 18*a*. Alternatively, when the cover is positioned such that the ball 19 engages the other hole of each pair of parallel holes, the pocket 15*a* can be aligned with the narrow hole 18*b*, whereby the pocket body 15 and the pocket cover 18 can be secured in the position where the ball is inserted. The pocket cover 18 is provided with a pin 21 which is used for adjusting the length of winding material between successively produced air core coils.

As shown in FIG. 4, a side frame 22 is secured to the shaft 11. The winding material is slid on an adhesive agent rod 23, whereby an adhesive agent is applied to the winding material. After that, the winding material is guided to the winding core 13 via a guide roller 24.

In the multiply connected air core coil winding apparatus, by activating the cylinder 9, the side frame 22 approaches the side frame face 17. By further activating the cylinder 14, the winding core 13 is protruded through the side frame face 17 so as to be located between the side frame face 17 and the side frame 22.

The winding material is directed to the winding core 13 and then the rotation shaft 1 is rotated. As a result, the winding material is wound onto the winding core 13 while the winding core 13 is located between the side frame 22 and the side frame face 17. An air core coil with side faces is made by the side frame 22 and the side frame face 17.

Before the winding material is guided by the guide roller 24, the adhesive agent is applied to the winding material by the adhesive agent rod 23. Therefore, when the winding material has been wound, the adhesive agent is hardened, thereby insulating each portion of the winding material and preventing the air core coil from being deformed.

After a while, one air core coil has been completely wound. By activating the cylinder 9 in the reverse direction, the side frame 22 is retracted from the side frame face 17. After that, by activating the cylinder 14 in the reverse direction, the winding core 13 is retracted back into the side frame face 17.

Consequently, the air core coil is removed from the winding core 13. By rotating the pocket cover 18, the pocket 15*a* and the hole 18*a* are aligned with each other and the pocket 15*a* is opened. With the pocket 15*a* aligned with the hole 18*a*, the thus wound air core coil is manually inserted into the pocket 15*a* and retained therein for a subsequent winding operation.

After the air core coil where the winding material has been completely wound is housed in the pocket 15*a*, by rotating the pocket cover 18 in the reverse direction, the pocket 15*a* is aligned with the narrow hole 18*b* and the winding material is removed from the narrow hole 18*b*.

By performing the winding operation in the same manner as described above where the air core coil around which the winding material has been completely wound, is housed in the pocket 15*a* and is therefore rotated along with the winding core 13, the next winding operation can be performed without cutting the winding material.

Figure 3:
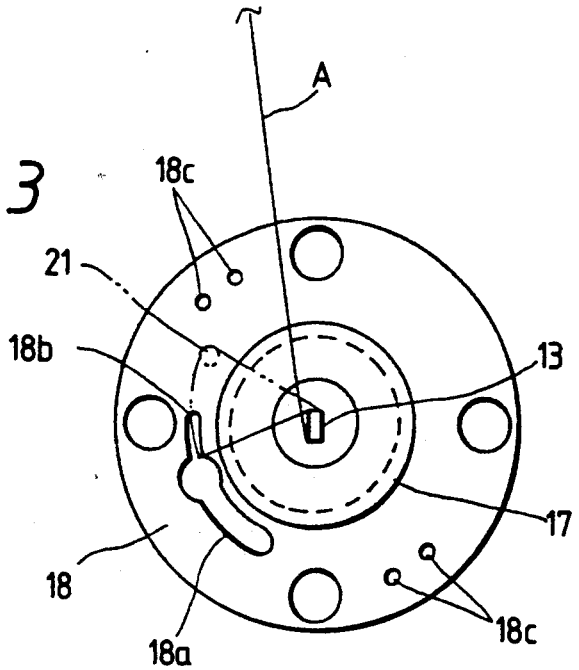

By repeating the above operation, the required number of multiply connected air core coils can be successively made. However, when the next winding operation is performed, as shown in FIG. 3, the length of the winding material between the air core coils can be increased by passing the winding material A to a pin 21. When a third winding occurs, for example, the first and second air core coils having been completely wound are housed in pocket 15*a* during the winding of the third air core coil. It should be noted that the air core coils are very small so that several air core coils can be housed in the pocket 15*a*.

Figure 5:
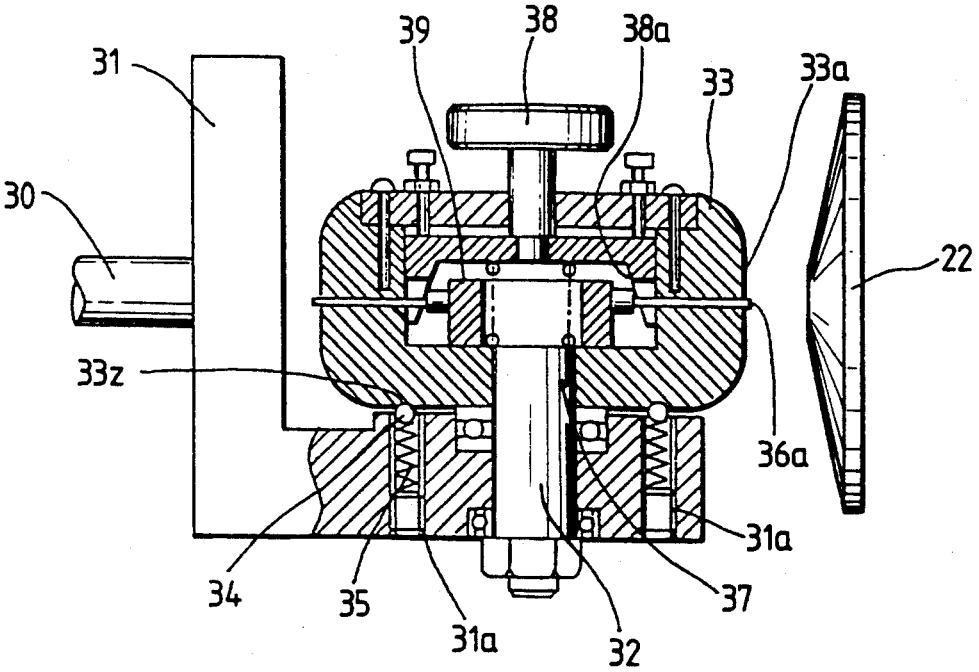
FIGS. 5 and 6 show the principal section of a second embodiment of the present invention.
Figure 6:
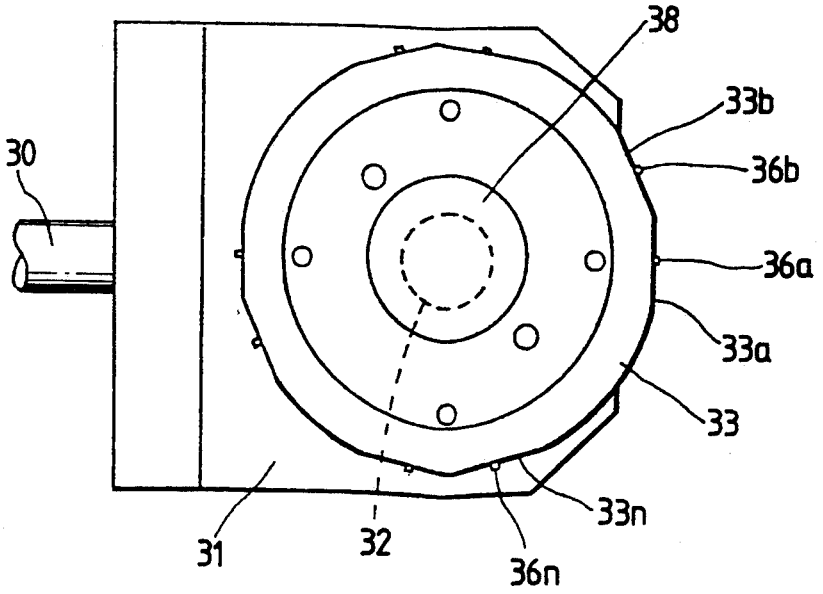

By referring to FIGS. 5 and 6, a second embodiment of the present invention is described.

In the figures, a winding shaft 30 relates to the rotation shaft 7 of the first embodiment. The side frame 22 of the first embodiment is also used in the second embodiment. The sliding and rotating operations of the second embodiment are the same as those of the first embodiment.

An L-shaped rotation frame 31 is fastened to the winding shaft 30. A shaft 32 which is rotatably disposed perpendicularly to the winding shaft 30 is mounted on the rotation frame 31.

A side frame 33 is fastened to the shaft 32, and a plurality of side frame faces 33*a* to 33*n* are disposed parallel to the shaft 32. A dent portion 33*z* is secured by a ball 34 and a spring 35, both of which are inserted into a hole 31*a* of the rotation frame 31. When the dent portion 33*z* is secured, one of the side frame faces 33*a* to 33*n* is positioned so as to be opposed to the side frame 22.

Winding cores 36*a* to 36*n* are movably inserted into the side frame faces 33*a* to 33*n* so that the side frame faces 33*a* to 33*n* are concentrically disposed to the winding shaft 30 when the side frame faces 33*a* to 33*n* are opposed to the side frame 22.

A push down handle 38, which is tensioned and pushed down by a spring 37, is housed in the side frame 33, the push down handle 38 being vertically movable. When the push down handle 38 is pushed down, a slope face 38*a* thereof causes the winding cores 36*a* to 36*n* to be inserted into the side frame faces 33*a* to 33*n* against the elasticity of silicon rubber 39 which outwardly tensions the winding cores 36*a* to 36*n*.

In the multiply connected air core coil winding apparatus, the side frame 33 is rotated by the shaft 32. The side frame face 33*a* is secured in a position opposed to the side frame 22 by the ball 34 at the dent portion 33*z*.

Similar to the first embodiment described above, after the side frame 22 is moved toward the side frame face 33*a*, the winding shaft 30 is rotated so that the winding is wound on the winding core 36*a* when it is located between the side frame 33 and the side frame 22.

After the winding operation is completed, the side frame 22 is retracted from the side frame face 33*a*, and the side frame 33 is rotated around the shaft 32 in order to select a different side frame face, for example, side frame face 33*b*. At that time, the rotation of the side frame 33 is stopped by the ball 34, similar to the first embodiment.

In the same manner as the first embodiment, the winding material is wound around winding core 36*b* which is now located between the side frame face 33*b* and the side frame 22. By repeating this operation, after the winding material is wound on the side frame faces 33*c* to 33*n*, the push down handle 38 is pushed down.

At that time, the winding cores 36*a* to 36*n* are moved towards the silicone rubber 39, whereby the winding cores 36*a* to 36*n* are inserted into the side frame faces 33*a* to 33*n*. Consequently, the air core coils which have been wound on the winding cores 36*a* to 36*n* can be removed.

By adjusting an angle between the two successive side frame faces 33*a* to 33*n*, the length of the winding material between the air core coils can be changed.

As described above, according to the present invention, multiply connected air core coils can be wound without cutting the winding material.

Therefore, when two or more air core coils which are connected in series are used as a tracking coil in an optical pickup which reads signals from a video disk and which optically stores information, or which reads signals from an optical disk for a digital audio system called a compact disk, it is not necessary to peel the insulator of each end of the winding material on each coil and to solder each end of the coil to joints of a board.

Thus, as well as omitting such an operation, boards and lands used for joints are not required, thereby reducing the space required for the unit where the coils are used.

In addition, the multiply connected air core coils can be wound in the same manner as the conventional coils. Thereby, it is possible to partially modify the conventional winding apparatus.

What is claimed is:

1. A multiply connected air core coil winding apparatus for forming a plurality of air core coils formed of a winding material, said apparatus comprising:

a first side frame;

a second side frame;

means for moving at least one of said first side frame and said second side frame to a winding position wherein said first side frame and said second side frame define the width limits of a coil formed during a winding operation;

said second side frame comprising a many faceted member having plural faces around the periphery thereof; said many faceted member being rotatable about a first axis parallel to said faces to provide any of said faces in position to face said first side frame; and a projection serving as a winding core during winding operations protruding from each of said faces and contacting said first side frame when the respective face faces said first side frame and when in said winding position; and rotatable support means for supporting said second side frame and rotating said second side frame about a second axis coincident with the longitudinal axis of said projection extending radially from said second side frame which is contacting said first side frame so as to attendantly wind said winding material on said projection.

2. A multiply connected air core coil winding apparatus as claimed in claim 1, further comprising means for retracting said projections following winding operations.

3. A multiply connected air core coil winding apparatus for winding a winding material around said core, comprising:

a winding rotation shaft;

a pair of side frames positioned opposite to one another, a first side frame being capable of being drawn towards and away from a second side frame and a plurality of side frame faces being located on said second side frame;

means for securing said second side frame to said winding rotation shaft such that said second side frame is rotatable along with rotation of said rotation shaft and such that said second side frame is rotatable about an axis which is perpendicular to said rotation shaft and parallel to said side frame faces; and a plurality of winding cores which are inserted into said plurality of side frame faces, respectively, and on which air core coils may be wound;

wherein said second side frame is rotated about said axis to position a selected one of said plurality of side frame faces in opposition to said first side frame, a corresponding selected one of said plurality of winding cores extending between said pair of side frames during winding and retracted after winding is complete, said winding occurring by rotating said second side frame about said winding shaft to cause said winding material to be wound around said cores.

* * * * *